US008739352B2

(12) United States Patent
Smith

(10) Patent No.: US 8,739,352 B2
(45) Date of Patent: Jun. 3, 2014

(54) TOUCHSCREEN SMUDGE ERASER

(76) Inventor: Kevin Smith, Troy, OH (US)

( * ) Notice: Subject to any disclaimer, the term of this patent is extended or adjusted under 35 U.S.C. 154(b) by 186 days.

(21) Appl. No.: 13/363,676

(22) Filed: Feb. 1, 2012

(65) Prior Publication Data

US 2012/0192372 A1 Aug. 2, 2012

Related U.S. Application Data

(60) Provisional application No. 61/438,689, filed on Feb. 2, 2011.

(51) Int. Cl.
*A47L 25/00* (2006.01)

(52) U.S. Cl.
USPC ..... 15/210.1; 15/209.1

(58) Field of Classification Search
USPC ..... 15/209.1–210.1, 231, 220.1, 214
See application file for complete search history.

(56) References Cited

U.S. PATENT DOCUMENTS

| | | | | |
|---|---|---|---|---|
| 3,339,220 | A * | 9/1967 | Barry | 15/233 |
| 5,477,582 | A * | 12/1995 | Yamashita | 15/231 |
| 2007/0074360 | A1* | 4/2007 | Gurley | 15/118 |
| 2007/0079461 | A1* | 4/2007 | Huang | 15/210.1 |
| 2009/0106924 | A1* | 4/2009 | Park | 15/190 |

FOREIGN PATENT DOCUMENTS

| | | | | |
|---|---|---|---|---|
| JP | 11-56745 | A * | 3/1999 | A47L 25/00 |

* cited by examiner

*Primary Examiner* — Laura C Guidotti
(74) *Attorney, Agent, or Firm* — Stockwell & Smedley, PSC

(57) ABSTRACT

The present invention relates to a device or apparatus for wiping and cleaning the surface of an electronic device screen. The device comprises a base and a blade covered with a blade fabric, such as microfiber, with the blade inserted into the base. A user may grip the base to apply the blade to the screen surface. The blade may have a blade support under the blade fabric to provide some rigidity and resiliency to the blade fabric. A cap is further provided for reversibly coupling to the base of the device when not in use to protect the blade. The blade may also be reversibly coupled to the base to allow for its replacement. A replacement blade itself is also provided.

25 Claims, 5 Drawing Sheets

TOUCHSCREEN SMUDGE ERASER

CROSS-REFERENCE TO RELATED APPLICATIONS

This application claims the benefit of priority of U.S. Provisional Application No. 61/438,689, entitled "Smudge Eraser," filed on Feb. 2, 2011, the entire contents and disclosure of which are incorporated herein by reference.

BACKGROUND

1. Field of the Invention

The present invention relates generally to an article or device for wiping or cleaning the surface of a handheld device, such as a touch screen.

2. Related Art

Hand-held computing devices and smart phones, such as a BlackBerrys®, iPhones®, iPads®, etc., have become increasingly popular in recent years. One common feature of these and other devices is a display screen that may also be a means for receiving user input. For example, the now familiar touch screens allow users to utilize their hands, fingers, or a stylus to input information into, and interact with, the display of a hand-held or other computing device. However, one problem with these devices is that the interface or screen can easily become dirty due to being routinely touched, etc., even with normal use, which not only detracts from the appearance of the device and obscures the viewability of the screen, but may also make the device less responsive to user input due to interference.

One approach to address this problem has been to place a removable protective cover or sheet (made of a transparent or see-through material) over the screen that allows tactile input to be detected while protecting the screen. However, these covers can be difficult to place evenly on the screen surface, and they have the inconvenience and cost of needing to be periodically removed, discarded and replaced with a new sheet, in part due to dirt and other marks building up on the protective cover itself over time. Thus, there remains a need in the art for an improved article or device for cleaning device screens that does not require cover sheets and that is simple to use, easy to carry and inexpensive to produce.

SUMMARY

According to a first broad aspect of the present invention, a device or apparatus for wiping and/or cleaning an electronic screen is provided, comprising: a blade having a blade support and a blade fabric; and a base having a top portion, a bottom portion, a front face, a back face and two sides, wherein a distal portion of the blade is covered with the blade fabric, and wherein a proximal portion of the blade is configured to be inserted into an opening in the top portion of the base and a cavity inside the base that is continuous with the opening.

According to a second broad aspect of the present invention, an original or replacement blade is provided comprising: a blade support; a blade fabric; and a blade holder, wherein the blade support is folded over to form a distal end along the fold of the blade support and two proximal ends, wherein the blade fabric is overlaid onto the blade support to cover at least a distal portion of the blade, and wherein the blade holder includes a front piece and a back piece that are coupled together to enclose a proximal portion of the blade support and to hold the proximal ends of the blade support together.

Various other aspects and methods may also be provided that are consistent with present description and drawings.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

Figure 6A:
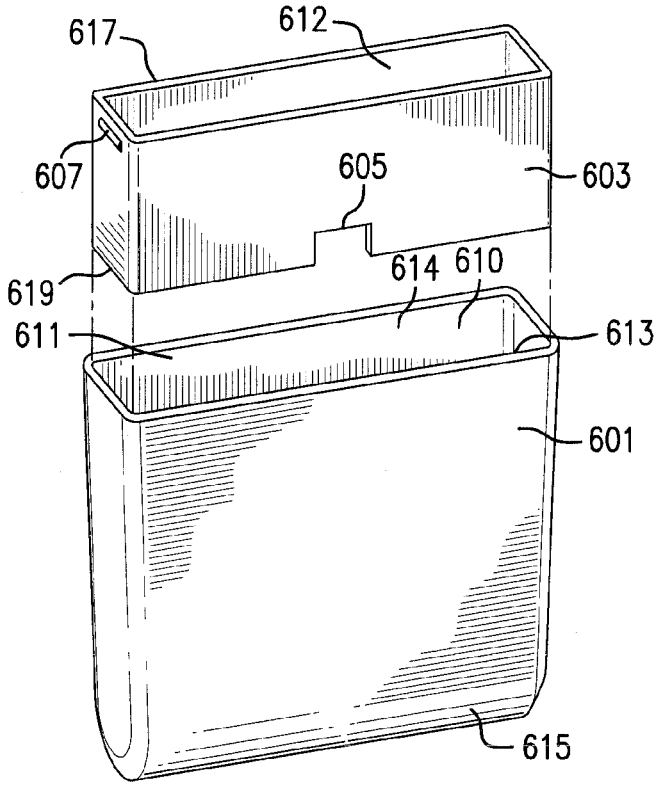
Figure 7:
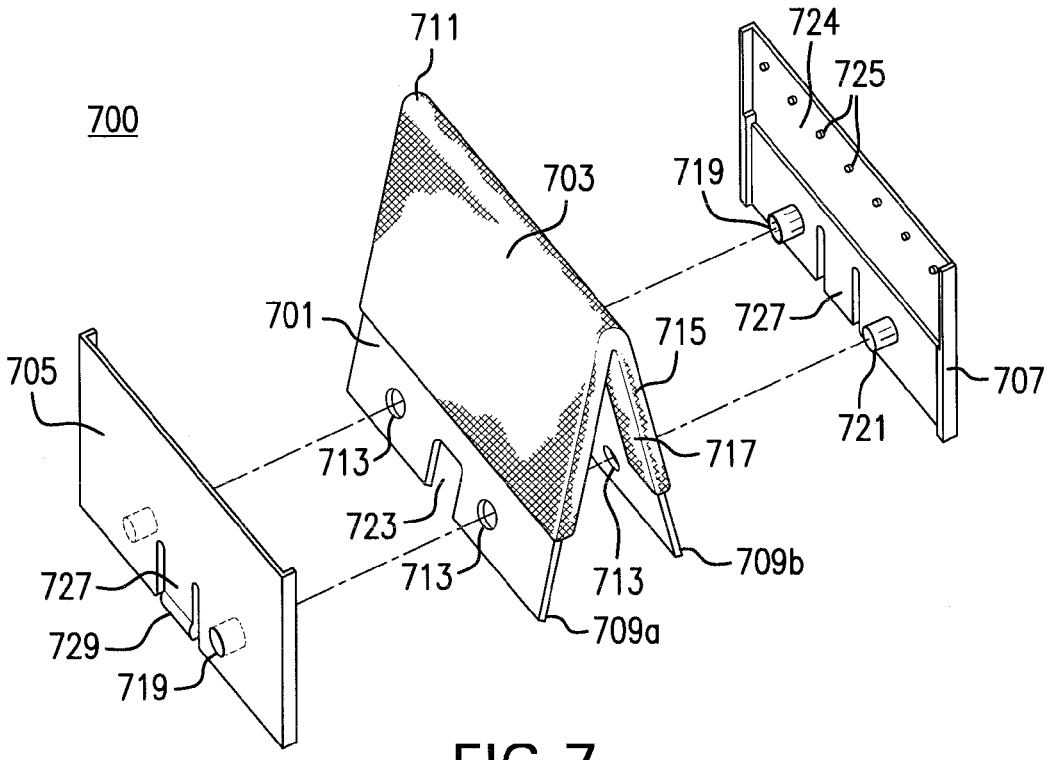

FIG. **6*a*** is an exploded view of a base of a two-piece device of the present invention showing a blade holder apart from a main base;

FIG. **6*b* is a cross-sectional view of the base of the two-piece device of the present invention in FIG. 6*a* showing the interior of the blade holder and main base; and FIG. 7** is an exploded view of a blade of the present invention that may serve as a replacement showing the construction of the blade holder, blade support and blade fabric.

DETAILED DESCRIPTION OF THE INVENTION

The detailed description set forth below in connection with the appended drawings is intended as a description of various embodiments of the invention and is not intended to represent the only embodiments in which the invention may be practiced. The detailed description includes specific details for the purpose of providing an understanding of the invention. However, it will be apparent to those skilled in the art that the invention may be practiced without these specific details.

The present invention relates generally to a small article, apparatus or device for wiping or cleaning the surface of the screen of an electronic or computerized device, such as a touch screen of a hand-held device or smart phone. The device is conveniently sized and shaped (e.g., small enough with no sharp edges) to be easily and comfortably carried or transported by a user, such as in the user's clothing pocket, bag or purse. The device will generally have at least (1) a body or base portion sized appropriately for gripping by the fingers and/or the hand of a user and (2) a "blade" comprising a fabric for directly contacting and wiping the screen when used. The blade is inserted into the base of the device so that the user may control the wiping of the screen surface by the blade during use by gripping and transferring movement to the base. In this way, the device may be used to clean the face of the display screen by removing smudges, marks, fingerprints, oils, dirt, etc., that might obscure viewing of the display and/or interfere with user input.

According to embodiments of the present invention, a device is provided having a base and a blade as mentioned above. The base will generally have a small dimension, which may be defined by one or more height and width dimensions when viewing its front face or back (or rear) face, and by one or more depth dimensions when viewed on the left or right sides. The base of the device may have different height, width and/or depth dimensions at different locations or portions of the base depending on its shape. The base may potentially be a variety of shapes. When viewed at its front or back face, the base may have a rectangular, square, curved, etc., shape, which may result in different dimensions at different locations. When the front and back faces of the base have a square or rectangular shape, the height and width dimensions of the base may generally be substantially the same or constant. However, when the device has a curved or irregular shape and no position is specified, its height, width and depth dimensions will refer to its greatest height, width and depth dimensions, respectively.

Figure 1:
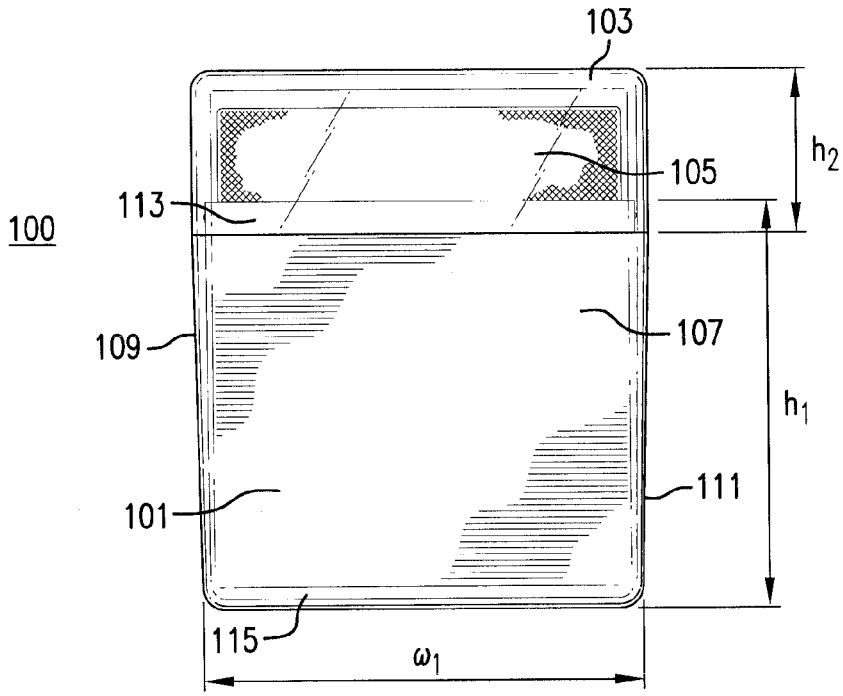
FIG. 1 is a front elevational view of a device according to an embodiment of the present invention.

FIGS. 1-4 show an example embodiment of the present invention displaying many of the features of the present invention. FIG. 1 provides a front elevational view of a device embodiment 100 of the present invention showing a blade 103 inserted into an upper or top portion 113 of a base 101. The device 100 in FIG. 1 is viewed at a front face 107 of the base 101 with the left side 109, the right side 111 and the bottom portion 115 of the base 101 also shown. The overall shape of the example embodiment 100 in FIG. 1 is approximately rectangular when viewed at its front face. The device 100 in FIG. 1 is shown with a cap or cover 103 attached to the base 101 to protect the blade 103. The cap 103 and base 101 may generally have the same width such that the cap 103 to the base 101 are aligned and create a straight and consistent side edge for the device when they coupled together. The cap 103 is removed to expose blade 105 for use. Although cap 103 is shown as being transparent in this example, the cap 103 may also be non-transparent or solid colored like the base 101. By having a transparent cap 103, the color of the blade 105 may be displayed when not in use. It is also envisioned that the blade may be made retractable such that a cap would not be needed to protect the blade (not shown). According to these alternative embodiments, the blade may be moved in and out of the base by sliding a knob on the side of the base.

The base may generally be hollow with a cavity formed therein enclosed by the sides, front and back faces, and the bottom portion of the base. The top or upper portion of the base may have an opening to the outside from the cavity. However, it is also conceivable that the bottom portion of the base may also be open from the cavity to the outside, and thus provide a second opening in the base. The opening on the top portion of the base will generally be configured to receive the blade having the blade fabric for wiping the screen surface. The cavity that is continuous with the opening on the top portion of the base may be relatively shallow and only extend deeply enough toward the bottom portion to receive the blade, or alternatively the cavity may be deep enough to reach near (or through) the bottom portion of the base (i.e., extend most or nearly all of height of the base, or the entire height of the base), or any distance in between.

In those embodiments where a second opening is formed in the bottom portion of the base (in addition to the opening in the top portion), it is further envisioned that the second opening will also be configured to receive a second blade. According to these embodiments, the first blade and the second blade could have complementary roles. For example, one of the blades may have a ribbed fabric, whereas the other blade may have a polishing fabric. The fabrics of the two blades may also be made to have different colors, appearances, etc.

The base may be made of any suitable material that is hard and solid, such as plastic, metal, such as aluminum or steel, etc. The base height and width dimensions may generally be measured as the total or greatest height and width dimensions of the base when viewing the front and back faces of the base, whereas the depth dimension(s) of the base will generally be measured on the left and right sides of the base between the front and rear faces. The height and width dimensions of the base may each vary from about 0.5 inch to about 3 inches, or alternatively from about 1 inch to about 2 inches. According to some embodiments, the width of the base is greater than the height of the base. For example, the height and width of the base may be $h_1$ and $w_1$, respectively, as represented in FIG. 1. Within these ranges, the base and blade may be sized appropriately according to its intended use (e.g., based on the size of the screen for which it will serve as an accessory).

The depth of the sides of the base may vary from about 1/16 inch to about 1 inch, or alternatively from about 1/8 inch to about 1/2 inch. The depth of the base may generally be less than both the height and width dimensions. The depth of the base may be about the same regardless of position, or alternatively the depth may change depending on the position along the sides. According to some embodiments, the front and back faces of the base may be sloped or tapered toward each other at an angle in a direction toward the bottom portion of the base, such that the depth near the bottom portion of the base is narrower than the depth near the top portion of the base. As shown in the left side view in FIG. 2, the base 101 may have a first depth $d_1$ at a first position near the top of the base 101 and a second depth $d_2$ at a second position near the bottom of the base 101. According to this embodiment, the first depth ($d_1$) will be greater than the second depth ($d_2$). For purposes of the present invention, the term "sloped" in reference to the front and back faces of the base refers to the front and back faces not being parallel to the major or longitudinal axis of the sides of the device or its base. This configuration and shape with the sloped faces may help with gripping the device of the present invention by providing more friction or resistance for the user's fingers to press against when wiping the screen surface.

Figure 2:
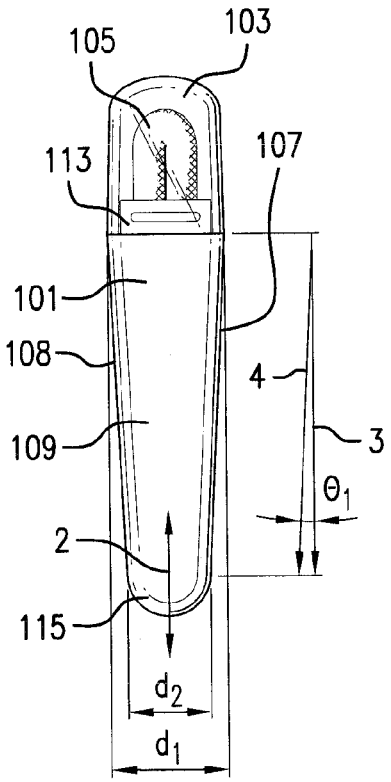
FIG. 2 is a side elevational view of a device according to an embodiment of the present invention.

FIG. 2 shows an example embodiment of the present invention with the front face 107 and the back face 108 of the base 101 sloped or tapered toward each in a direction toward the bottom portion 115 of the base 101. In this example, the front face 107 slopes toward an imaginary longitudinal or major axis 2 through the center of the left side 109 of the base 101 at an angle $\theta_1$ shown as the angle between an imaginary line 4 parallel to the front face 107 of the base 101 and an imaginary line 3 parallel to the longitudinal or major axis 2 of the left side 109 of the base 101. Another angle $\theta_2$ may be similarly formed by a sloping back face 108 (not shown). The front and back sloping angles $\theta_1$ and $\theta_2$ may generally be the same or approximately the same, although these angles may also be different. The angles $\theta_1$ and $\theta_2$ may each be from about 1° to about 10°, or alternatively from about 2° to about 5°.

According to embodiments of the present invention, the base may be made of a single piece or multiple pieces. As mentioned above, the top portion of the base will have an opening formed therein that is continuous with the cavity in the base, and a proximal portion of the blade will be inserted into the opening and cavity to connect the blade to the base. To stop the advance of the blade into the cavity of the base (i.e., to have the distal portion of the blade be extended above the base a sufficient distance for use), the cavity of the base may have one or more ledge(s) formed therein extending inwardly from the interior wall(s) of the front, back and/or side(s) of the base. These ledges may thus narrow the cavity and stop the blade from being inserted further into the base once the proximal side of the blade and the ledge(s) meet. Alternatively, the bottom of the cavity itself may be shallow enough to serve the same purpose by stopping any further advancement of the blade into the base once the proximal side of the blade and the bottom of the cavity meet. As described in greater detail below, according to some embodiments, the base may comprise multiple pieces including a blade base and a main base. According to these embodiments, one or more ledge(s) and/or the bottom of the cavity in the main base may sever to stop further insertion of the blade base and/or blade into the main base.

Figure 3:
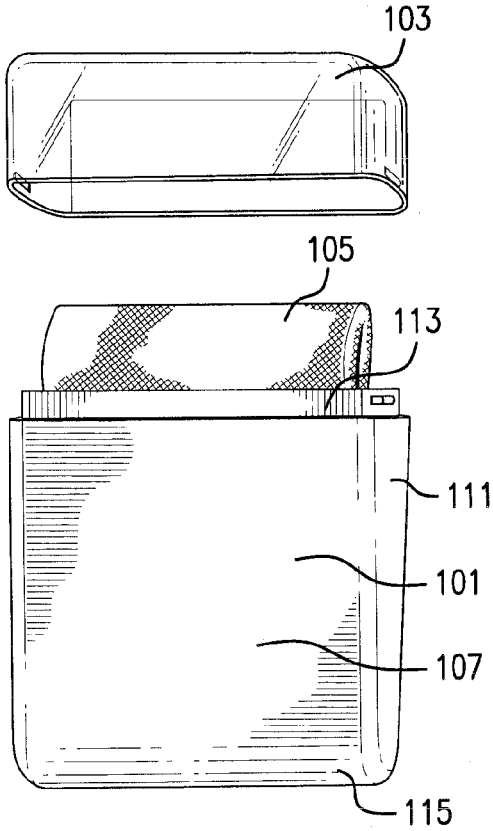
FIG. 3 is a perspective view of a device according to an embodiment of the present invention showing the cap removed.
Figure 4:
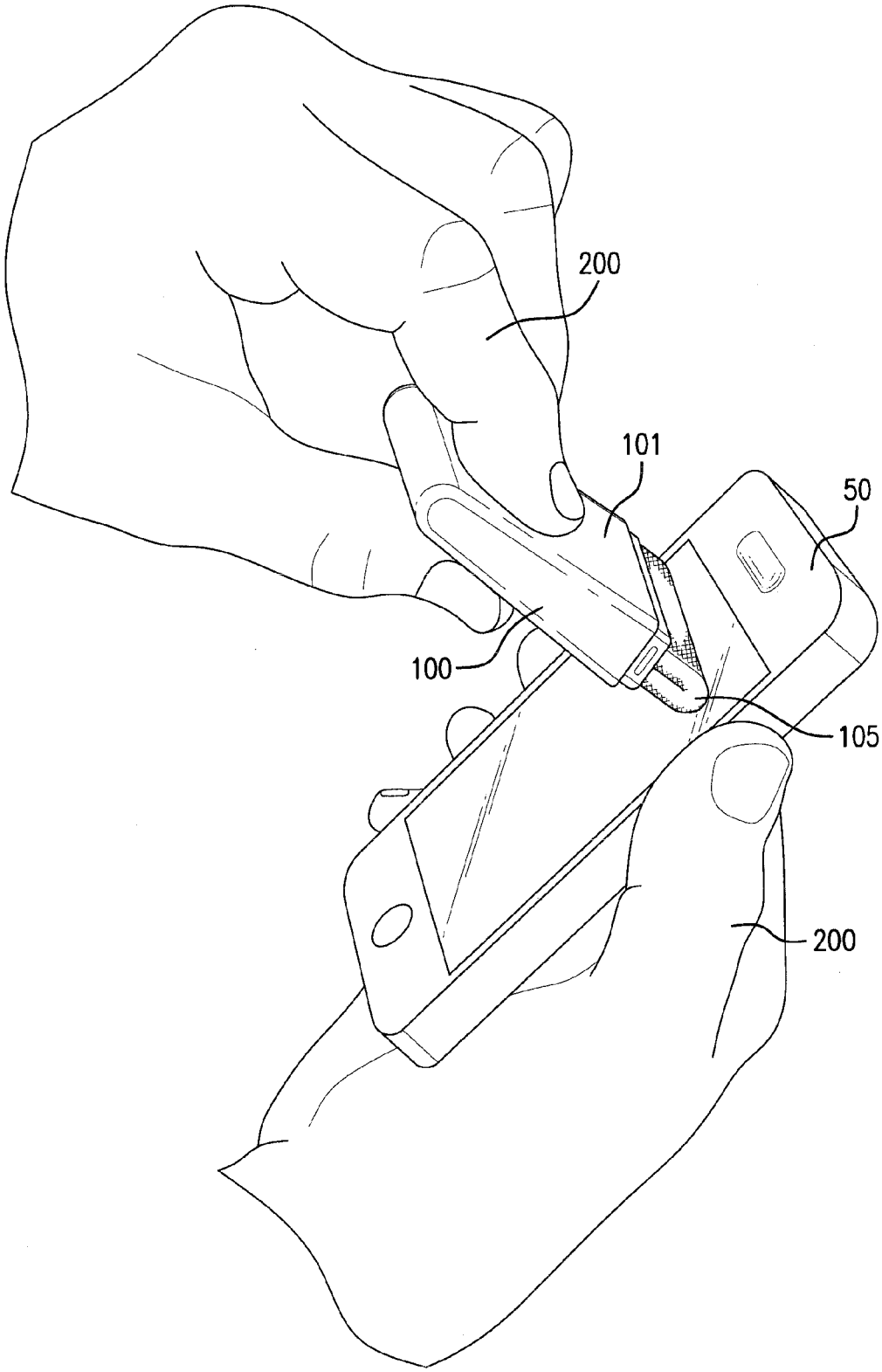
FIG. 4 provides a perspective view of the device of the present invention in use to wipe and clean the surface of a separate electronic device.

To allow the device of the present invention to be used, any cap covering the blade is removed. For example, FIG. 3 shows a cover or cap 103 removed from the device 100 to expose the blade for use. After removing the cap 103 of the device 100, the hand and/or fingers 200 of a user may grip the base 101 of device 100 to apply the blade 105 to the screen surface of an electronic device 50 as shown in FIG. 4. The cap 103 may generally have width and depth dimensions that are about the same as the width and depth dimensions of at least the top portion 113 of the base 101, and a height dimension (e.g., $h_2$ as shown FIG. 1) that may generally be less than the height dimension (e.g., $h_1$ as shown FIG. 1) of the base 101.

The blade may be generally comprised of a blade support, a blade fabric and optionally a blade holder. The blade fabric may be disposed or wrapped around and/or on top of the blade support to at least partially or fully cover at least a distal side, portion or end of the blade support. The blade support may generally provide resiliency to the fabric when the device of the present invention is used to press the fabric against the screen. The blade support may comprise one or more sheet(s) of material over which the blade fabric is placed in close contact to cover at least most of the distal end of the blade support. The blade support may also comprise a sheet of material that is folded over at or near its middle with the outside of the fold forming a distal end of the blade support, and the two folded over ends of the sheet of material forming a proximal end(s) of the blade support. The blade fabric may also be glued or taped to the blade support to help hold it in place.

In general, the proximal portion of the blade (with or without the blade holder) may be sized to match approximately the inner dimensions of the cavity of the base at least near the top portion of the base (see below). The blade support may be made of a variety of materials, such as plastic, etc., that are generally resilient and stiff enough when formed into the blade support to maintain its form, but also flexible or pliable enough to bend or flex a little when under pressure (i.e., when it is pressed against a surface). The combination and configuration of the blade fabric and the blade support as part of the device of the present invention may generally have (1) a proximal side or portion (at or near the proximal end of the blade support) that is inserted into the base, and (2) a distal side or portion (at or near the distal end of the blade support) defining a blade or working edge covered by the blade fabric that contacts and wipes the screen during use.

The proximal side or portion of the blade may have a size and shape (with or without the blade holder described below) that is about the same as that of the top opening of the base, such that that the blade closely or snugly fits into the base opening (i.e., with little or no gaps between the proximal side or portion of the blade and the interior walls of the base). For example, the proximal portion of the blade may also be from about 0.5 inch to about 3 inches in the width dimension, and about 1/16 inch to about ½ inch, or to about 1 inch, in the depth dimension, depending on the inner dimensions of the base. The blade assembly and the base may have corresponding features for coupling them together, such as the tab/projection on the proximal portion of the blade and the corresponding notch on the base as described below. Alternatively, a magnetic coupling is also envisioned. The blade may be reversibly coupled to the base and thus removable to allow for its replacement.

The blade may also comprise a blade holder. Much like the base and blade support, the blade holder may be made of a similar hard or rigid material, such as plastic metal, etc. The blade holder may surround, enclose or cover at least most (if not all) of a proximal portion of the blade including the proximal end(s) of the blade support and/or the blade fabric near the proximal end(s) (but not the distal portion of the blade). The features of the blade holder may serve several functions including (1) holding the two proximal ends of a folded blade support together, (2) holding or clasping the blade fabric to the blade support, (3) having a size and dimensions that match or correspond to the size and dimensions of the opening on the top portion of the base for tight or close-fitting insertion into the opening, and/or (4) providing a coupling feature for mating with the base to help hold and secure the blade to the base (at least temporarily or reversibly).

The blade holder of the blade may be made of one or more pieces. According to some embodiments, the blade holder is made of two pieces that are coupled or fastened together (e.g., snapped, glued, etc.). For example, a first piece of the blade holder may have a peg extending from its inner surface, and the other second piece may have a hole through it at a corresponding location for receiving the peg. By snapping the peg into the opposing hole, the two pieces of the blade holder may be held or secured together. The two pieces of the blade holder may have two or more complementary fastener pairs, such as the peg and hole combination, at multiple corresponding locations on the two opposing pieces for holding or securing them together, and each of these fastener pairs on the two opposing pieces may have the same or opposing orientation (s).

Figure 5:
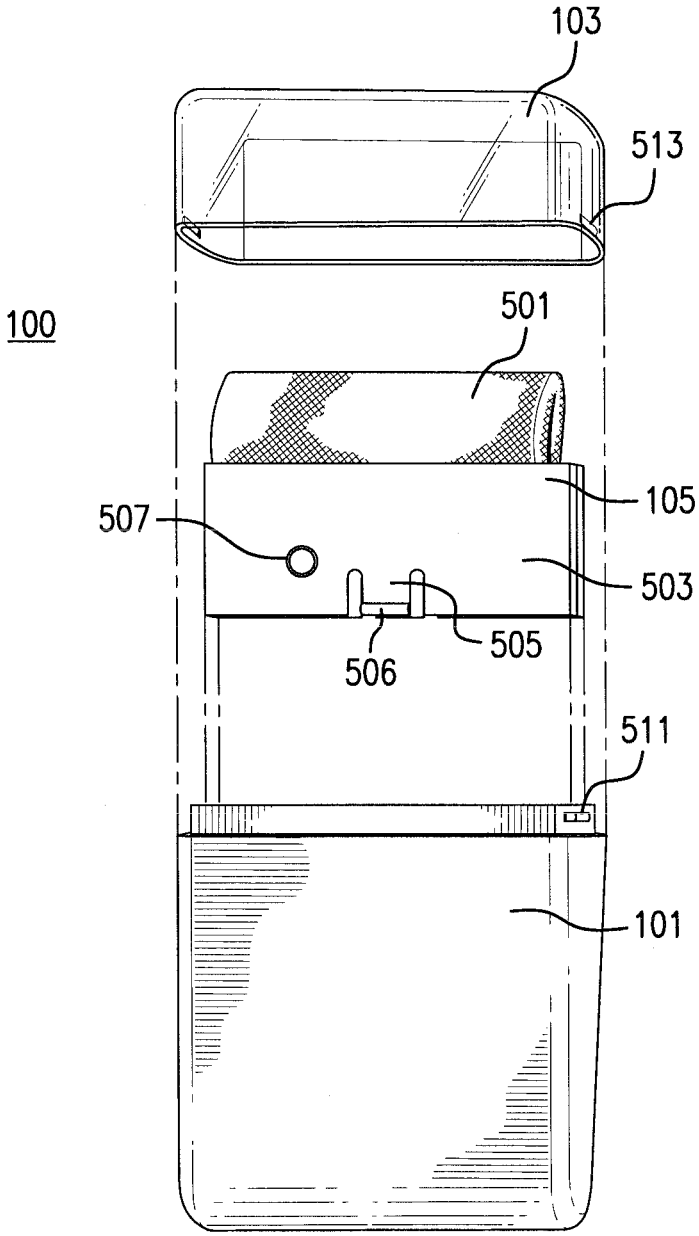
FIG. 5 is an exploded view of a device of the present invention showing the cap and the blade removed from the base for possible replacement of the blade.

FIG. 5 is an exploded perspective view of a device 100 of the present invention showing the blade 105 and the cap 103 removed from the base 101 for possible replacement or attachment of the blade 105. In this example, the blade 105 comprises a blade fabric 501 over a blade support (not viewable) with the proximal ends of the blade fabric 501 and blade support held together by a blade holder 503. For example, the blade holder 503 may have two pieces that may be held together by at least one fastener having corresponding parts, such as a hole 507 in one of the two pieces for receiving a corresponding peg from the opposing piece of the blade holder 503 to snap them together. The blade holder 503 may also have a tab 505 with a projection 506 for engaging and reversibly connecting or coupling to a corresponding notch (not viewable) on the base 101 of device 100. Also shown in FIG. 5 is a projection 511 on one or both sides of a top portion of the base 101 for mating and coupling with a corresponding projection or indentation 513 to reversibly secure or couple the cap 103 to the base 101 when not in use to stably protect and cover blade 105.

The blade fabric may potentially include any suitable fabric or cloth for wiping and cleaning the surface of a screen without scratching or damaging it. According to many preferred embodiments, the blade fabric comprises a microfiber material. The microfiber may be made of high gloss (glossy) thread fibers having a sleek, smooth and satin-like feel. The side of the microfiber blade fabric on the distal portion of the blade that will contact the screen surface may have a repeated corduroy-like pattern with a series of ribs parallel with the blade edge. The microfiber blade fabric may comprise a combination of polyester and polyamide fibers, such as split corrugated fibers, which may be in ranges from about 20% to about 30% polyamide fiber and from about 70% to about 80% polyester. To increase the attractiveness, appeal and marketing of the device, the blade fabric may be a variety of different colors that a purchaser could choose.

According to many embodiments, the blade fabric substantially or entirely covers the distal portion of the blade such that the device can clean the screen surface regardless of the direction of wiping. Although a microfiber material may be preferable as a blade fabric, other similar fibers or materials are also contemplated. In addition, the blade fabric may be further impregnated with additives to aid with smudge removal and/or to provide anti-bacterial or other disinfecting benefits.

As introduced above, the base of the device of the present invention may be made of a single piece or multiple pieces. According to some embodiments where the blade base is made of multiple pieces, the base may comprise at least two pieces: a main base and a blade base. For example, as shown in FIG. 6*a*, a proximal side 619 of blade base 603 may be inserted into opening 611 of cavity 610 at top portion 613 of main base 601. The cavity 610 may extend deeply into main base 601 but be enclosed by the sides of main base 601 and at bottom portion 615 of main base 601. The blade holder 603 may have a notch 605 formed therein in the front and/or back sides for receiving and coupling with blade (e.g., reversibly coupling with tab 505 with projection 506 on blade holder 503 as shown in FIG. 5).

The blade base 603 may also have a cavity 612 formed therein that becomes continuous with cavity 610 of main base 601 when blade base 603 is inserted into main base 601. As shown, width and depth dimensions of blade base 603 may be sized to fit closely or snugly into opening 611 and cavity 610 in the top portion 613 of main base 601 (i.e., with little or no gaps between blade base and interior walls in top portion 613 of main base 601). The blade base 603 may have one or more projections 607 formed on its sides for mating and coupling with corresponding feature(s) of cap (not shown).

Figure 6B:
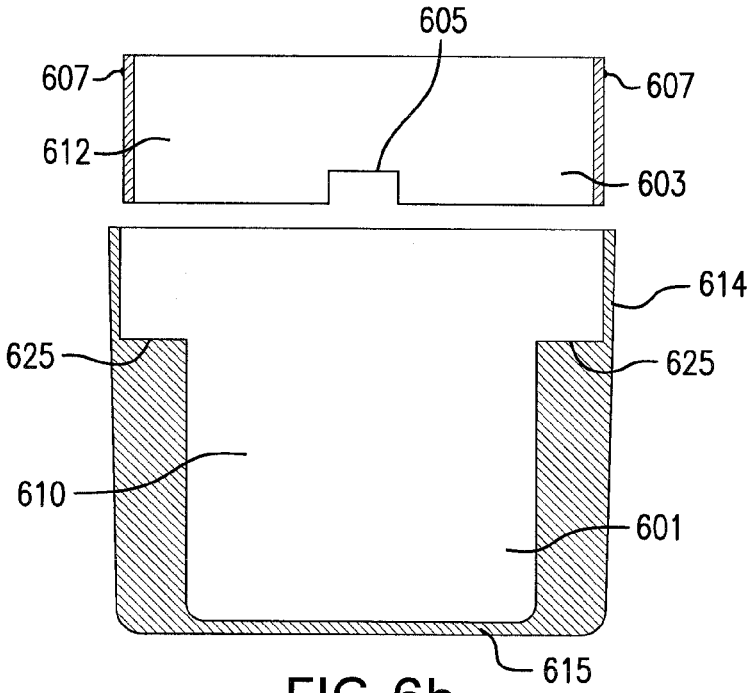

FIG. 6*b* shows a vertical cross-sectional view through the center of the main base 601 and blade base 603. Notch 605 and projections 607 on blade base 603 and the cavities 610, 612 of main base 601 and blade base 603, respectively, are shown. According to some embodiments, one or more ledges 625 in the cavity 610 of main base 601 may extend inwardly from the interior wall(s) 614, such as the interior side wall(s), of the main base 601. According to these embodiments, the ledges 625 may not only stop the further insertion of blade into main base 601 (not shown), but may also serve to position and stop the further insertion of the blade base 603 into main base 601. The blade base may be secured to the main base by any suitable method, such as by gluing, etc.

As described above, a blade may be inserted into an opening on the top portion of the base. According to some embodiments, the blade may be inserted into an opening on the distal side of a blade base forming part of the base. In either case, the inner dimensions of the opening and cavity formed at the top portion of the base or in the cavity of the blade base will be approximately the same as the outer dimensions of a proximal side or portion of the blade, such as the outer dimensions of a blade holder forming part of the blade. This close or snug fit will help the blade to be securely coupled to the base so that it does not slip or wobble during use. In addition, as further described above, any fastener or other means may be used to at least reversibly (if not permanently) couple and hold the blade to the base. Preferably the blade is reversibly coupled or connected to the base so that the blade is held in place for use but may be removed for replacement by pulling it out of the base.

According to embodiments of the present invention, a blade is provided that may serve as an original blade or its replacement. The construction of the blade may be generally as described above. FIG. 7 shows an exploded view of an example embodiment of the present invention with a blade support 701 folded over such that a distal end 711 is formed along the fold line and two proximal ends 709*a*, 709*b*. A blade fabric 703 is overlaid on the blade support 701 in close contact with blade support 701 mainly over the distal end 711 of the blade support, such as to cover the distal end 711 of the blade support. The blade fabric 703 may also extend down the faces of the blade support 701 and toward the proximal end(s) 709*a*, 709*b* of the blade support 701. However, at least a portion of the blade support 701 near the proximal end(s) 709*a*, 709*b* may be left uncovered by the blade fabric 703. The blade fabric 703 may also be wrapped around the side(s) 715 of the blade support 701 and possibly secured, such as by gluing, taping, etc., to at least a portion of the underside of the blade support 717 on one or both side(s). The underside(s) of a blade support may generally refer to the inner faces of the two folded parts or halves of the blade support that are facing each other when the blade support is folded over.

The blade may further comprise a blade holder comprising one or more pieces. The blade support in FIG. 7 is shown with a front piece 705 and a back piece 707 that become coupled or secured together with at least a proximal portion of the blade support sandwiched in between. The front piece 705 and back piece 707 may have a corresponding fastener pair(s) on their inner side(s) 724, such as a peg on one and a corresponding hole on the other. For example, FIG. 7 shows a peg 721 on back piece 707 that is able to couple and become secured to hole 719 on front piece 705. FIG. 7 also shows a peg 721 (hidden) on front piece 705 for coupling or securing to corresponding hole 719 on back piece 707. By securing the front piece 705 to the back piece 707, the blade support 701 having the blade fabric 703 is held in between. The blade support may also have one or more holes 713 disposed therein near the proximal end(s) 709*a*, 709*b* that allow the peg(s) 721 and/or hole(s) 719 to extend through hole(s) 713 of blade support 701 such that the front and back pieces 705, 707 of the blade holder may be secured together to hold the blade support 701. The front and back pieces 705, 707 of the blade holder may also have one or more small point projections 725 on the inner side 724 of the front and/or back pieces 705, 707 of the blade holder that help grip the blade fabric 703 on the blade support 701 and hold the fabric 703 in place and avoid its shifting during use.

As described above, the front and bask pieces 705, 707 of the blade holder may also have a tab(s) on their proximal side with projection 729 for mating with a corresponding feature of the base to reversibly couple the blade 700 to the base. The proximal end(s) 709*a*, 709*b* blade support 701 may also have one or more carve-out(s) 723 positioned to correspond to the position of the tab(s) 727 on the front and/or back pieces 705, 707 of the blade holder to allow the tab(s) 727 to flex freely when blade 700 is inserted into base of device.

The device or apparatus of the present invention may be made to have and present a variety of different colors, shapes or designs for appearance and marketing. The base, cap and blade holder may each be made of a plastic that is transparent or solid colored. In addition, it is further envisioned that the base, cap and/or blade holder may be made of metal, such as aluminum, steel, etc., to give a different look. Likewise, the color of the blade fabric may also be varied for presentation purposes. Any combination of colors and designs for the individual components of the device is contemplated for potential appeal or fashion. The device may also be made to display artwork, graphics or messages to allow users to personalize their accessory when desired.

The previous description is provided to enable any person skilled in the art to practice the various embodiments described herein. Reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

While the present invention has been disclosed with reference to certain embodiments, it will be apparent that modifications and variations are possible without departing from the spirit and scope of the invention as defined in the appended claims. Furthermore, it should be appreciated that all examples in the present disclosure, while illustrating embodiments of the invention, are provided as non-limiting examples and are, therefore, not to be taken as limiting the various aspects so illustrated. The present invention is intended to have the full scope defined by the language of the following claims, and equivalents thereof. Accordingly, the drawings and detailed description are to be regarded as illustrative and not as restrictive.

What is claimed is:

1. A device for wiping an electronic screen, comprising:
- a blade having a blade support and a blade fabric; and
- a base having a top portion, a bottom portion, a front face, a back face and two sides,
- wherein a distal portion of the blade is covered with the blade fabric, and
- wherein a proximal portion of the blade is configured to be inserted into an opening in the top portion of the base and a cavity inside the base that is continuous with the opening,
- wherein the depth of the base at a first position at or near the top portion of the base is greater than the depth of the base at a second position at or near the bottom portion of the base, and
- wherein the front face or the back face of the base are sloped at an angle in a range from about 1° to about 10° relative to a line parallel to the major longitudinal axis of the side of the base.

2. The device of claim 1, wherein the proximal portion of the blade is configured to fit closely into the opening or the cavity in the top portion of the base.

3. The device of claim 2, wherein the width and depth dimensions of the proximal portion of the blade are approximately the same as the width and depth dimensions of the opening and the cavity near the top portion of the base such that the proximal portion of the blade fits closely into the cavity of the base near the top portion of the base when inserted.

4. The device of claim 1, wherein the blade fabric covers a distal end of the blade support.

5. The device of claim 1, wherein the proximal portion of the blade has a tab and projection for reversibly coupling the blade to the base.

6. The device of claim 1, wherein the height and width dimensions of the base are each in a range from about 1 inch to about 2 inches.

7. The device of claim 1, wherein the depth of the base is in a range from about ⅛ inch to about ½ inch.

8. The device of claim 1, wherein the width of the base is greater than the height of the base, and wherein the height and width of the base are each greater than the depth of the base.

9. The device of claim 1, wherein the blade fabric comprises microfiber.

10. The device of claim 9, wherein the blade fabric comprises from about 20% to about 30% polyamide fiber and about 70% to about 80% polyester fiber.

11. The device of claim 9, wherein the blade fabric is a high-gloss microfiber having a series of ribs oriented parallel to the edge of the distal end of the blade.

12. The device of claim 1, wherein the front face or the back face of the base are sloped at an angle in a range from about 2° to about 5° relative to a line parallel to the major longitudinal axis of the side of the base.

13. The device of claim 1, wherein the base has one or more ledges extending inward into the cavity of the base from one or more interior walls of the base.

14. The device of claim 13, wherein the one or more ledges are configured to stop further insertion of the blade into the base.

15. The device of claim 1, wherein the base comprises a main base and a blade base.

16. The device of claim 15, wherein the blade base is configured to fit closely into an opening and a cavity in the top portion of the main base, and wherein the main base has one or more ledges extending inward into the cavity of the main base from one or more interior walls of the main base to stop further insertion of the blade base into the main base.

17. The device of claim 15, wherein the blade has one or more tabs each with a projection for reversibly coupling to one or more notches in the blade base.

18. A device for wiping an electronic screen, comprising:
- a blade having a blade support and a blade fabric; and
- a base having a top portion, a bottom portion, a front face, a back face and two sides, and
- a cap configured to be reversibly coupled to the base and to cover the blade when attached,
- wherein a distal portion of the blade is covered with the blade fabric,
- wherein a proximal portion of the blade is configured to be inserted into an opening in the top portion of the base and a cavity inside the base that is continuous with the opening, and
- wherein the cap has a height that is less than the height of the base, and wherein the cap has a width and depth that are approximately the same as the width and depth of the base at or near the top portion of the base.

19. The device of claim 18, wherein the width and depth dimensions of the proximal portion of the blade are approximately the same as the width and depth dimensions of the opening and the cavity near the top portion of the base such that the proximal portion of the blade fits closely into the cavity of the base near the top portion of the base when inserted.

20. The device of claim 18, wherein the height and width dimensions of the base are each in a range from about 1 inch to about 2 inches.

21. The device of claim 18, wherein the depth of the base is in a range from about ⅛ inch to about ½ inch.

22. The device of claim 18, wherein the width of the base is greater than the height of the base, and wherein the height and width of the base are each greater than the depth of the base.

23. The device of claim 18, wherein the blade fabric comprises microfiber.

24. The device of claim 18, wherein the front face or the back face of the base are sloped at an angle in a range from about 1° to about 10° relative to a line parallel to the major longitudinal axis of the side of the base.

25. The device of claim 18, wherein the base has one or more ledges extending inward into the cavity of the base from one or more interior walls of the base, and wherein the one or more ledges are configured to stop further insertion of the blade into the base.

* * * * *